US005882130A

United States Patent [19]

Kumazaki et al.

[11] Patent Number: 5,882,130

[45] Date of Patent: Mar. 16, 1999

[54] PAPER DETECTION DEVICE FOR PRINTER

[75] Inventors: Masayuki Kumazaki; Naoto Yamaguchi; Hiroshi Ishida; Yukihiro Uchiyama; Kazuhiko Yamaguchi, all of Nagano, Japan

[73] Assignee: Seiko Epson Corporation, Tokyo-to, Japan

[21] Appl. No.: 950,112

[22] Filed: Oct. 16, 1997

Related U.S. Application Data

[63] Continuation of Ser. No. 615,922, Mar. 14, 1996, abandoned.

[30] Foreign Application Priority Data

Mar. 22, 1995 [JP] Japan ..... 7-088813

[51] Int. Cl.[6] ..... B41J 13/00

[52] U.S. Cl. ..... 400/642; 400/578; 400/596; 271/265.01

[58] Field of Search ..... 400/596, 578, 400/642; 271/265.01

[56] References Cited

U.S. PATENT DOCUMENTS

| | | | |
|---|---|---|---|
| 4,085,931 | 4/1978 | Szeluga et al. | 271/265.01 |
| 4,671,441 | 6/1987 | Hauslaib | 271/265.01 |
| 4,793,605 | 12/1988 | Tajima | 271/265.01 |
| 4,814,825 | 3/1989 | Johdai et al. | 271/265.01 |
| 5,028,041 | 7/1991 | Kobayashi | 271/9 |
| 5,042,790 | 8/1991 | Miller et al. | 270/110 |
| 5,347,350 | 9/1994 | Nakahata et al. | 271/265.01 |
| 5,356,130 | 10/1994 | Infanger | 271/263 |
| 5,820,282 | 10/1998 | Nakai | 400/642 |

FOREIGN PATENT DOCUMENTS

| | | | |
|---|---|---|---|
| 556486 | 8/1932 | European Pat. Off. . | |
| 3531461 | 3/1986 | Germany . | |
| 54-65969 | 5/1979 | Japan | 271/265.01 |
| 3-43015 | 9/1991 | Japan . | |
| 6-263284 A | 9/1994 | Japan | 271/265.01 |
| 218151 | 7/1924 | United Kingdom . | |

OTHER PUBLICATIONS

British Search Report dated 23 Apr. 1996.

*Primary Examiner*—Edgar Burr
*Assistant Examiner*—Amanda B. Sandusky
*Attorney, Agent, or Firm*—Stroock & Stroock & Lavan LLP

[57] ABSTRACT

A paper detection device for a printer, includes: a support member; a main lever pivotably mounted on the support member, wherein the main lever has a self-resetability to an upright position and is pivotable only in a sheet-feed-direction; an auxiliary lever pivotably mounted on the main lever, including a free end protruding into a sheet passage, wherein the auxiliary lever has a self-resetability and moves the main lever in the sheet-feed direction when the free end thereof is urged in the sheet-feed direction, but does not move the main lever in a reverse-sheet-feed direction when the free end of the auxiliary lever is urged in a reverse-sheet-feed direction.

19 Claims, 2 Drawing Sheets

PAPER DETECTION DEVICE FOR PRINTER

This is a continuation of application Ser. No. 08/615,922, filed on Mar. 14,1996 for PAPER DETECTION DEVICE FOR PRINTER, now abandoned.

BACKGROUND OF THE INVENTION

The present invention relates to a paper detection device for a printer.

For instance, a printer where printing on both cut sheets and continuous form are available needs to draw back a loaded continuous form from a printing area before printing on a cut sheet or to draw out a cut sheet at a paper jam treatment.

A detection sensor published on Japanese Utility Model Publication No. Hei. 3-43015 has a sheet end detection lever formed by an angled bar that may withdraw from a sheet feed passage when a print sheet is fed in either direction.

The angled detection lever of Hei. No. 3-43015, however, inaccurately detects paper because the timing of the paper detection depends upon the movement of the angled lever, which in turn depends upon the thickness of the paper and the rigidity of the lever. Thus, decreasing the thickness of the paper and increasing the rigidity of the lever decreases the likelihood of accurate paper detection, as the lever is less likely to move when paper is fed past the lever.

The present invention concerns such a problem as described above and thus the object of the invention is to provide a new paper detection device which performs accurate paper detection without impeding paper when it is fed in the sheet-feed direction or in the reverse-sheet-feed direction.

According to an aspect to the present invention, there is provided a paper detection device for a printer including: a support member; a main lever pivotably mounted on the support member, wherein the main lever has a self-resetability to an upright position and is pivotable only in a sheet-feed direction; an auxiliary lever pivotably mounted on the main lever that includes a free end that protrudes into a sheet passage, wherein the auxiliary lever has a self-resetability to an upright position, is pivotable with respect to the main lever only in a reverse-sheet-feed direction, and moves the main lever in the sheet-feed direction when the free end thereof is urged to the sheet-feed direction, but does not move the main lever in a reverse sheet feed direction when the free end of the auxiliary lever is urged in a reverse sheet feed direction.

BRIEF DESCRIPTION OF THE DRAWINGS

FIG. 2(*b*) is cross-sectional view of the paper detection device in a second position when paper is fed in a paper-feed direction;

FIG. 2(*c*) is a cross-sectional view of the paper detection device in a third position when paper is fed in a reverse-paper-feed direction.

DETAILED DESCRIPTION OF THE PREFERRED EMBODIMENTS

An embodiment of the present invention is described below.

Figure 3:
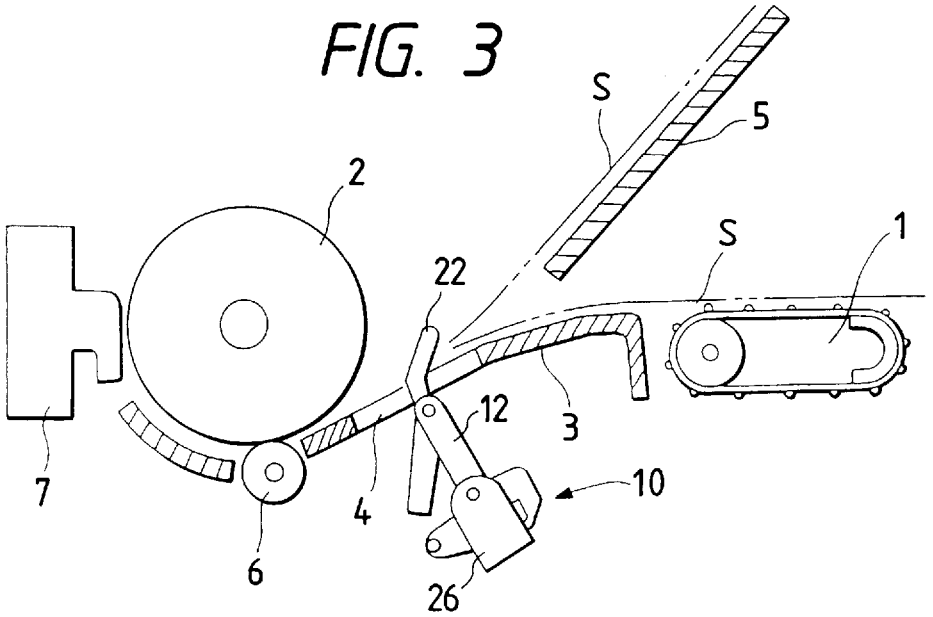
FIG. 3 is a cross-sectional view of a printer equipped with the paper detection device.

As is shown in FIG. 3, a paper detection unit 10 is located in a position where a sheet guide 3, which extends from a push tractor 1 to a platen 2, joins a sheet guide 5, which extends from a cut sheet feeder (not shown) to the platen 2. Sheet guide 5 has a slit 4 through which paper detection unit 10 extends to detect the presence of paper in the paper path. FIG. 3 also depicts a print head 7 and a pinch roller 6, which is located in a position where it is capable of contacting and separating from the circumferential surface of the platen 2.

Figure 1:
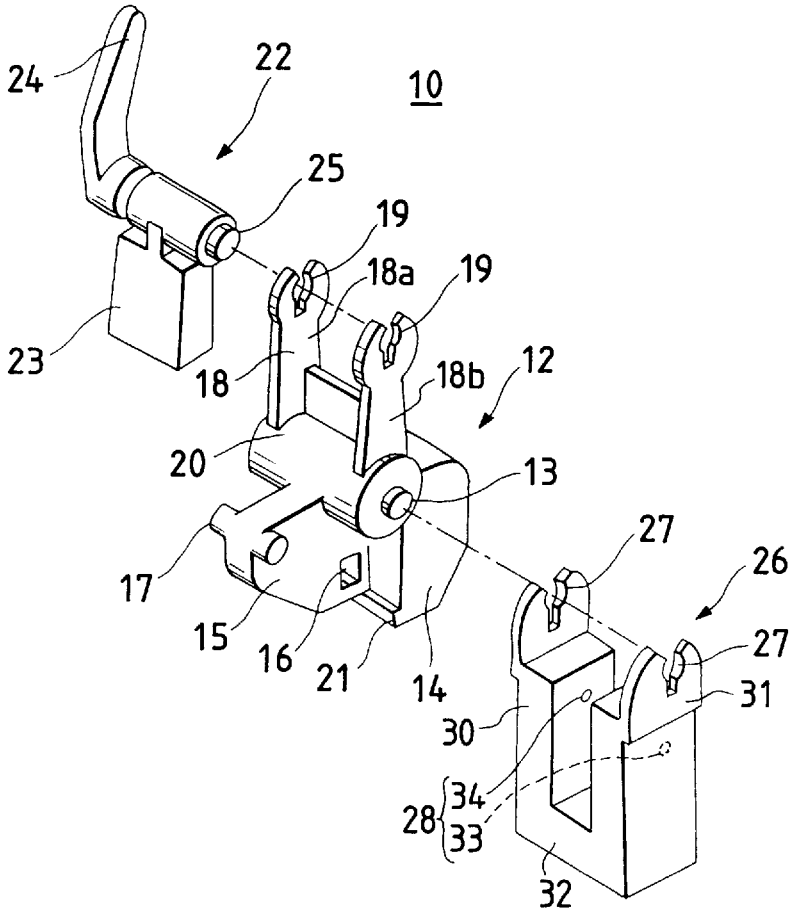
FIG. 1 is an exploded perspective view of a paper detection device according to the present invention.

Turning to FIG. 1, the paper detection unit 10 includes a support member 26, a main lever 12, and an auxiliary lever 22. Main lever 12 is pivotably mounted on support member 26. Auxiliary lever 22 is pivotably mounted on main lever 12.

Support member 26 is formed in a U-shape, having a first arm 30 and a second arm 31, and a base 32 that connects first and second arm 30 and 31. Support member 26 is secured on the frame of a printer main body, (not shown). First and second arms 30 and 31 are formed to receive shaft 13, and each have shaft bearings 27 so that support member 26 pivotally supports main lever 12 with shaft bearings 27. A photoelectric-converter-type paper detection sensor 28 includes a light emitting element 33 mounted on the inside of either first arm 30 or second arm 31, and a light receiving element 34 mounted on the opposing side of either first arm 30 or second arm 31

Main lever 12 includes a shaft 13, a weight 14, a light shield plate 15, a U-shaped member 18, and a rotation control piece 20. Weight 14 and plate 15 are formed on the lower half of main lever 12 below shaft 13, which is preferably located at the longitudinal center of main lever 12. U-shaped member 18 constitutes the upper half of main lever 12, and supports auxiliary lever 22. U-shaped member 18 has a first arm 18*a* and a second arm 18*b*, which are connected by shaft 13. First and second arms 18*a* and 18*b* each include shaft bearings 19 positioned to support auxiliary lever 22

Main lever 12 is supported pivotably on support member 26 in such a manner that main lever 12 is maintained in an upright position by weight 14. In this position, a window 16 within light shield plate 15 aligns with the optical path of paper detection sensor 28 of support member 26. Main lever 12 is constructed in such a manner that the optical path will be interrupted by light shield plate 15 when main lever 12 is contacted by auxiliary lever 22 which has been contacted by a sheet of paper fed in the sheet-feed direction.

Main lever 21 also includes a first stopper 17 and a second stopper 21. First stopper 17 is formed on plate 15 and second stopper 21 is formed on weight 14.

Auxiliary lever 22 includes a shaft 25 having a top and bottom and two ends, a free end 24 attached to one end of shaft 25, and a weight 23 attached to the bottom of shaft 25. Auxiliary lever 22 is pivotably supported by shaft bearings 19 located in the first and second arms 18*a* and 18*b* of main lever 12. Auxiliary lever 22 is supported in such a manner that free end 24 is biased by weight 23, so that free end 24 protrudes through slit 4 in sheet guide 3 when free end 24 is not in contact with a sheet of paper. Auxiliary lever 22 is constructed in such a manner that, when paper fed in the sheet-feed direction contacts auxiliary lever 22, the rotation of auxiliary lever 22 is limited by rotation control piece 20, which is formed on the top half of shaft 13 between first arm 18*a* and second arm 18*b* of main lever 12. Thus, when paper is fed in the sheet-feed direction, auxiliary lever 22 rotates in the counter-clockwise direction, contacts rotation control piece 20, which in turn rotates in the counter-clockwise direction together with main lever 12.

Figure 2A:
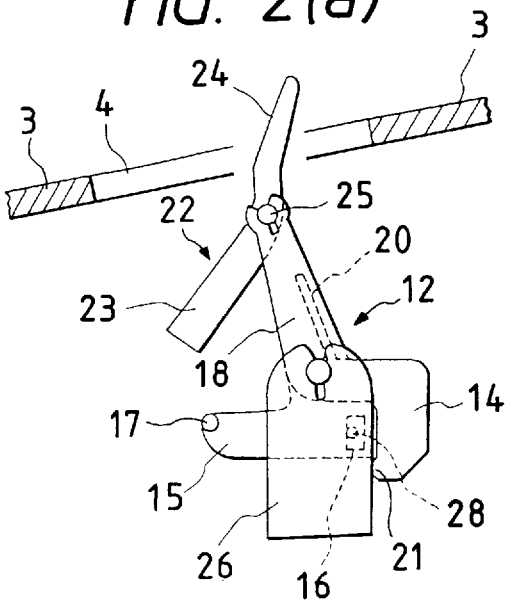
FIG. 2(*a*) is a cross-sectional view of the paper detection device in a first position when paper has not been fed.
Figure 2B:
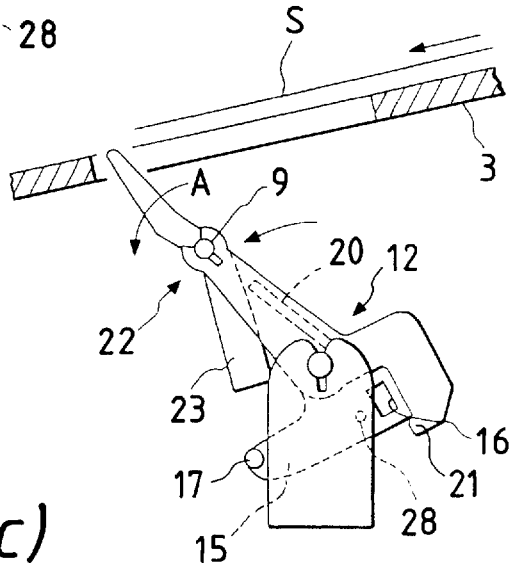
Figure 2C:
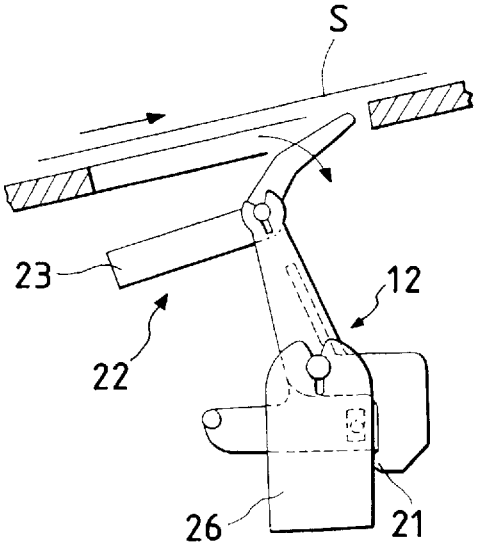

In such a device as detailed above, main lever 12 is maintained in the upright position by weight 14, as is shown in FIG. 2(*a*), in the absence of the feeding of a sheet S. In this position, window 16 is positioned such that the optical path of paper detection sensor 28 located inside support member 26 is not interrupted. Also, while main lever 12 is in an upright position, auxiliary lever 22, being pivotably supported at the free ends of U-shaped arm 18, is positioned by weight 23 such that free end protrudes through slit 4 in sheet guide 3.

As shown in FIG. 3, when a sheet of paper, either in a continuous or cut form, is fed from the push tractor 1 or from a cut sheet feeder (not shown), auxiliary lever 22 is pushed by the front edge of sheet S and rotates in the sheet-feed or counter-clockwise direction as is indicated by the arrow A in FIG. 2(*b*) until weight 23 contacts rotation control piece 20. At this point, the force of sheet S on auxiliary lever 22 causes main lever 12 to rotate with auxiliary lever 22, thereby allowing sheet S to pass over slit 4 to the far side of sheet guide plate 3. Main lever 12 is prevented from rotating in the counter-clockwise direction when stopper 17 contacts support member 26. When main lever 12 is caused to rotate in the counter-clockwise direction depicted by arrow A, window 16 is also caused to rotate counter-clockwise, thereby placing light shield plate 15 in the path of the beam of light emitted by light emitting element 33. In this manner, light receiving element 34 does not receive the beam of light, and the presence of a sheet in the paper path is detected.

When the rear edge of the print sheet S passes over slit 4, the force imparted by sheet S on auxiliary lever 22 disappears, and weight 23 causes auxiliary lever 22 to immediately rotate in the clockwise direction. When auxiliary lever 22 rotates in the clockwise direction, weight 23 is released from contact with rotation control piece 20, and weight 14 of main lever 12 immediately causes main lever 12 to rotate in the clockwise direction. Thus, absent the force provided by sheet S, auxiliary lever 22 and main lever 12 immediately assume the position depicted in FIG. 2(*a*).

When a paper jam requires the removal of a sheet S, as shown in FIG. 2(*c*), paper detection unit 10 permits the sheet S to move in a reverse-feed direction. When a sheet S is fed in the reverse-feed direction, auxiliary lever 22 is contacted by the back edge of sheet S, and auxiliary lever 22 moves clockwise from the upright position depicted in FIG. 2(*a*) to the position depicted in FIG. 2(*c*). When auxiliary lever 22 rotates in the clockwise direction, main lever 12 is maintained in its upright position as stopper 21 contacts the lateral wall of support member 26 to prevent movement of main lever 12 in the clockwise direction. After sheet S is fed past slit 4, the force of sheet S on auxiliary lever 22 disappears and auxiliary lever 22 immediately rotates counter-clockwise by the force of weight 23 and is reset to the upright position as shown in FIG. 2(*a*).

Thus, according to the present invention, auxiliary lever 22 is weighted so as to realign itself to an upright position in the absence of a sheet of paper being fed over slit 4. In addition, main lever 12 is also weighted so as to realign itself in the absence of a sheet of paper being fed over slit 4. However, main lever 12 is prevented from rotating in the clockwise direction when paper is fed in a reverse-paper-feed direction as shown in FIG. 2(*c*). The current configuration is advantageous in that it detects the presence of paper without lag time when paper is fed in the sheet feed direction, while resetting automatically to its original position in the absence of paper being fed in the sheet feed direction. Further, when a sheet of paper is in a reverse-feed direction, to clear a jam, for example, only the auxiliary lever moves in a clockwise direction.

What is claimed is:

1. A sheet detection device for a printer, comprising:

a support member;

a main lever, having a first end and a second end, and a stopper at said second end, said main lever pivotably mounted on said support member, wherein said main lever has a self-resetability to an upright position and is pivotable only in a sheet-feed direction from said upright position, and said main lever, when in an upright position, is prevented from moving in a reverse-sheet-feed direction by said stopper; and an auxiliary lever pivotably mounted on said first end of said main lever, said auxiliary lever including a free end protruding into a sheet passage and a portion weighted to urge said auxiliary lever to the upright position such that said auxiliary lever has a self-resetability to an upright position;

said support member, main lever and auxiliary lever constructed and arranged so that said auxiliary lever pivots in the counter-clockwise direction when paper is fed in the sheet-feed direction, and contacts said free end of said auxiliary lever, which causes said main lever to pivot in the counter-clockwise direction and detect the presence of paper, and whereby said auxiliary lever pivots in the clockwise direction when paper is fed in the reverse-sheet-feed direction to allow paper to pass through the sheet passage.

2. The sheet detection device according to claim 1, wherein said support member includes a photoelectric detector, and said main lever includes an interrupting portion for interrupting an optical path of the photoelectric detector.

3. The sheet detection device according to claim 1, wherein said main lever includes a plate that is contacted by said auxiliary lever when said auxiliary lever is urged in the sheet-feed direction.

4. The sheet detection device according to claim 1, wherein said main lever includes a weight for urging said main lever to the upright position.

5. The sheet detection device according to claim 1, wherein said support member includes a sensor, and said main lever includes an element which interacts with said sensor.

6. The sheet detection device according to claim 5, wherein said sensor emits light and said element is a window through which said light can pass when said main lever is in a selected position.

7. The sheet detection device of claim 1, wherein said support member, said main lever and said free end of said auxiliary lever are constructed and arranged to be substantially aligned with each other when said main lever and said auxiliary lever are in the upright position.

8. A paper detection device for a printer, comprising:

a support member;

a main lever having a shaft and a plate projecting upwardly from said shaft when said main lever is in an upright position pivotably mounted on said support member, wherein said main lever has a self-resetability to an upright position and is pivotable only in a sheet-feed direction from said upright position; and an auxiliary lever having a weight for urging said auxiliary lever to an upright position and a free end that protrudes into a sheet passage, wherein said auxiliary lever has a self-resetability to an upright position, and wherein said auxiliary lever weight contacts said main lever plate to urge said main lever in a counter-clockwise direction when said auxiliary lever is urged in a counter-clockwise direction when contacted by a sheet of paper fed in a sheet-feed direction.

9. The sheet detection device of claim 8, wherein said support member, said main lever and said free end of said auxiliary lever are constructed and arranged to be substantially aligned with each other when said main lever and said auxiliary lever are in the upright position.

10. A sheet detection device for a printer, comprising:

a support member;

a main lever pivotably mounted on said support member at a support point, said main lever including a first end, extending away from said support point in a first direction, a second end, extending away from said support point in a second direction substantially opposite to said first direction, and a stopper, said main lever having a self-resetability to an upright position and being pivotable only in a sheet-feed direction from said upright position, and wherein said main lever, when in an upright position, is prevented from moving in a reverse-sheet-feed direction by said stopper; and an auxiliary lever pivotably mounted on said main lever, said auxiliary lever including a free end protruding into a sheet passage, and wherein said auxiliary lever has a self-resetability to an upright position;

said support member, main lever and auxiliary lever constructed and arranged so that said auxiliary lever pivots in the counter-clockwise direction when paper is fed in the sheet-feed direction, and contacts said free end of said auxiliary lever, which causes said main lever to pivot in the counter-clockwise direction and detect the presence of paper, and whereby said auxiliary lever pivots in the clockwise direction when paper is fed in the reverse sheet-feed direction to allow paper to pass through the sheet passage.

11. The sheet detection device according to claim 10, wherein said support member includes a photoelectric detector, and said main lever includes an interrupting portion for interrupting an optical path of the photoelectric detector.

12. The sheet detection device according to claim 10, wherein said main lever includes a plate that is contacted by said auxiliary lever when said auxiliary lever is urged in the sheet-feed direction.

13. The sheet detection device according to claim 10, wherein said main lever includes a weight for urging said main lever to the upright position.

14. The sheet detection device according to claim 10, wherein said auxiliary lever includes a weight for urging said auxiliary lever to the upright position.

15. The sheet detection device according to claim 10, wherein said support member includes a sensor, and said main lever includes an element which interacts with said sensor.

16. The sheet detection device according to claim 15, wherein said sensor emits light and said element is a window through which said light can pass when said main lever is in a selected position.

17. The sheet detection device of claim 10, wherein said support member, said main lever and said free end of said auxiliary lever are constructed and arranged to be substantially aligned with each other when said main lever and said auxiliary lever are in the upright position.

18. A sheet detection device for a printer, comprising:

a support member;

a main lever pivotably mounted on said support member at a support point, said main lever including a first end, extending away from said support point in a first direction, a second end, extending away from said support point in a second direction substantially opposite to said first direction, and a stopper, said main lever having a self-resetability to an upright position and being pivotable only in a sheet-feed direction from said upright position, and wherein said main lever, when in an upright position, is prevented from moving in a reverse-sheet-feed direction by said stopper;

an auxiliary lever pivotably mounted on said first end of said main lever, said auxiliary lever including a free end protruding into a sheet passage, and wherein said auxiliary lever has a self-resetability to an upright position; and said support member, main lever and auxiliary lever constructed and arranged so that said auxiliary lever pivots in the counter-clockwise direction when paper is fed in the sheet-feed direction, and contacts said free end of said auxiliary lever, which causes said main lever to pivot in the counter-clockwise direction and detect the presence of paper, and whereby said auxiliary lever pivots in the clockwise direction when paper is fed in the reverse-sheet-feed direction to allow paper to pass through the sheet passage.

19. The sheet detection device of claim 18, wherein said support member, said main lever and said free end of said auxiliary lever are constructed and arranged to be substantially aligned with each other when said main lever and said auxiliary lever are in the upright position.

* * * * *